US011430350B2

(12) United States Patent
Nichols

(10) Patent No.: US 11,430,350 B2
(45) Date of Patent: Aug. 30, 2022

(54) MULTI-PURPOSE SIGNAGE ASSEMBLY

(71) Applicant: James W. Nichols, Lewis Center, OH (US)

(72) Inventor: James W. Nichols, Lewis Center, OH (US)

( * ) Notice: Subject to any disclaimer, the term of this patent is extended or adjusted under 35 U.S.C. 154(b) by 0 days.

(21) Appl. No.: 17/328,361

(22) Filed: May 24, 2021

(65) Prior Publication Data

US 2021/0375162 A1 Dec. 2, 2021

Related U.S. Application Data

(60) Provisional application No. 63/030,125, filed on May 26, 2020.

(51) Int. Cl.
*G09F 7/18* (2006.01)

(52) U.S. Cl.
CPC ..... *G09F 7/18* (2013.01); *G09F 2007/1843* (2013.01); *G09F 2007/1852* (2013.01); *G09F 2007/1865* (2013.01)

(58) Field of Classification Search
None
See application file for complete search history.

(56) References Cited

U.S. PATENT DOCUMENTS 3,762,360 A * 10/1973 Hawes ..... B60Q 7/005 116/28 R
4,609,133 A * 9/1986 Anderson ..... B60Q 1/50 224/317
4,613,847 A * 9/1986 Scolari ..... B60Q 7/00 362/418
4,751,494 A * 6/1988 Crotwell ..... B60Q 1/50 40/592
7,296,373 B1 * 11/2007 Hahn ..... G09F 15/0012 40/658
7,591,095 B2 * 9/2009 Kollmann ..... B60Q 7/02 40/607.04
7,631,467 B2 * 12/2009 Clarke ..... F16B 12/00 52/285.3
7,992,333 B1 * 8/2011 McGuinness ..... G09F 21/04 116/28 R
8,146,279 B2 * 4/2012 Elmer ..... G09F 21/04 40/592

(Continued)

*Primary Examiner* — David R Dunn
*Assistant Examiner* — Christopher E Veraa
(74) *Attorney, Agent, or Firm* — C. Fred Charpie, III; Ward Law Office LLC

(57) ABSTRACT

A multi-purpose signage assembly is provided. The multi-purpose signage assembly including a framework having a plurality of edges. The edges bounding opposing first and second panels. A first screen received by the first panel and a second screen received by the second panel. One of the plurality of edges having a plurality of slot assemblies. Another of the plurality of edges having a plurality of slot assemblies. A plurality of opposing magnets positioned in the plurality of slot assemblies of one of the edges or the slot assemblies of the other edge. The plurality of opposing magnets configured to attract each other in a manner such as to retain the opposing magnets in the slot assemblies. The plurality of opposing magnets further configured to attach the multi-purpose signage assembly to a ferrous surface with sufficient magnetic force to maintain the multi-purpose signage assembly in place.

18 Claims, 11 Drawing Sheets

(56) References Cited

U.S. PATENT DOCUMENTS

| | | | | |
|---|---|---|---|---|
| 8,742,917 | B2 * | 6/2014 | Ho | B60Q 7/00 116/63 P |
| 2006/0021267 | A1 * | 2/2006 | Matsuda | G02B 6/0053 40/546 |
| 2010/0290212 | A1 * | 11/2010 | Francis | G09F 7/04 362/97.3 |
| 2013/0160336 | A1 * | 6/2013 | Harman, Jr. | G09F 13/00 40/591 |
| 2017/0053574 | A1 * | 2/2017 | Byrd | G09F 21/04 |
| 2019/0232860 | A1 * | 8/2019 | Ferrone | B60Q 1/2615 |

* cited by examiner

MULTI-PURPOSE SIGNAGE ASSEMBLY

RELATED APPLICATIONS

This application claims the benefit of pending U.S. Provisional Patent Application No. 63/030,125, filed May 26, 2020, the disclosure of which is incorporated herein by reference in its entirety

BACKGROUND

In certain situations, a person may require assistance. The need for assistance can stem from a variety of situations including the non-limiting examples of a stalled vehicle, medical emergencies, losing direction during a hike in the woods, accidents and the like. In these instances, it can be desirable to alert other persons of the need for assistance.

Signage and signage assemblies can be used to alert others as to the need for assistance. Certain issues are noted in the structure, construction and use of prior art signage. The issues include the non-limiting examples of a lack of visibility, difficulties in the attachment and/or removal of the signage from the attachment location and difficulties in application to non-ferrous surfaces.

It would be advantageous if signage assemblies could be improved for use in multiple applications.

SUMMARY

It should be appreciated that this Summary is provided to introduce a selection of concepts in a simplified form, the concepts being further described below in the Detailed Description. This Summary is not intended to identify key features or essential features of this disclosure, nor it is intended to limit the scope of the multi-purpose signage assembly.

The above objects as well as other objects not specifically enumerated are achieved by a multi-purpose signage assembly. The multi-purpose signage assembly including a framework having a plurality of edges. The edges bounding opposing first and second panels. A first screen received by the first panel and a second screen received by the second panel. One of the plurality of edges having a plurality of slot assemblies. Another of the plurality of edges having a plurality of slot assemblies. A plurality of opposing magnets positioned in the plurality of slot assemblies of one of the edges or the slot assemblies of the other edge. The plurality of opposing magnets configured to attract each other in a manner such as to retain the opposing magnets in the slot assemblies. The plurality of opposing magnets further configured to attach the multi-purpose signage assembly to a ferrous surface with sufficient magnetic force to maintain the multi-purpose signage assembly in place.

The above objects as well as other objects not specifically enumerated are also achieved by a multi-purpose signage assembly. The multi-purpose signage assembly includes a framework having a plurality of edge. The edges bounding opposing first and second panels. The framework positioned on one side of a non-ferrous material. A first screen received by the first panel and a second screen received by the second panel. One of the plurality of edges having a plurality of slot assemblies. Another of the plurality of edges having a plurality of slot assemblies. A first plurality of opposing magnets positioned in the plurality of slot assemblies of one of the edges or the slot assemblies of the other edge. The first plurality of opposing magnets configured to attract each other in a manner such as to retain the opposing magnets in the slot assemblies. A second plurality of opposing magnets positioned on an opposing side of the non-ferrous material and configured to attract to the first plurality of opposing magnets with sufficient magnetic force to maintain the multi-purpose signage assembly in place against the non-ferrous material.

Various objects and advantages of the multi-purpose signage assembly will become apparent to those skilled in the art from the following Detailed Description, when read in light of the accompanying drawings.

DETAILED DESCRIPTION

The multi-purpose signage assembly will now be described with occasional reference to specific embodiments. The multi-purpose signage assembly may, however, be embodied in different forms and should not be construed as limited to the embodiments set forth herein. Rather, these embodiments are provided so that this disclosure will be thorough and complete, and will fully convey the scope of the multi-purpose signage assembly to those skilled in the art.

Unless otherwise defined, all technical and scientific terms used herein have the same meaning as commonly understood by one of ordinary skill in the art to which the multi-purpose signage assembly belongs. The terminology used in the description of the multi-purpose signage assembly herein is for describing particular embodiments only and is not intended to be limiting of the multi-purpose signage assembly. As used in the description of the multi-purpose signage assembly and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the multi-purpose signage assembly. Notwithstanding that the numerical ranges and parameters setting forth the broad scope of the multi-purpose signage assembly are approximations, the numerical values set forth in the specific examples are reported as precisely as possible. Any numerical values, however, inherently contain certain errors necessarily resulting from error found in their respective measurements.

Referring now to FIG. 1-4, a multi-purpose signage assembly (hereafter "signage assembly") is illustrated generally at 10. The signage assembly 10 is configured for several functions. First, the signage assembly 10 is configured to alert a person of the need for assistance. Second, the signage assembly 10 is configured for attachment to a variety of surfaces, in a variety of positions and orientations, with a novel attachment system. Finally, the signage assembly 10 is configured to draw attention from afar, with highly visible screens formed from one or more reflective materials. The signage assembly 10 includes a framework 12, a plurality of opposing first and second screens 14*a*, 14*b*, a plurality of spaced apart slot assemblies 16*a*-16*d* and a plurality of magnets 18*a*-18*h*.

Figure 5:
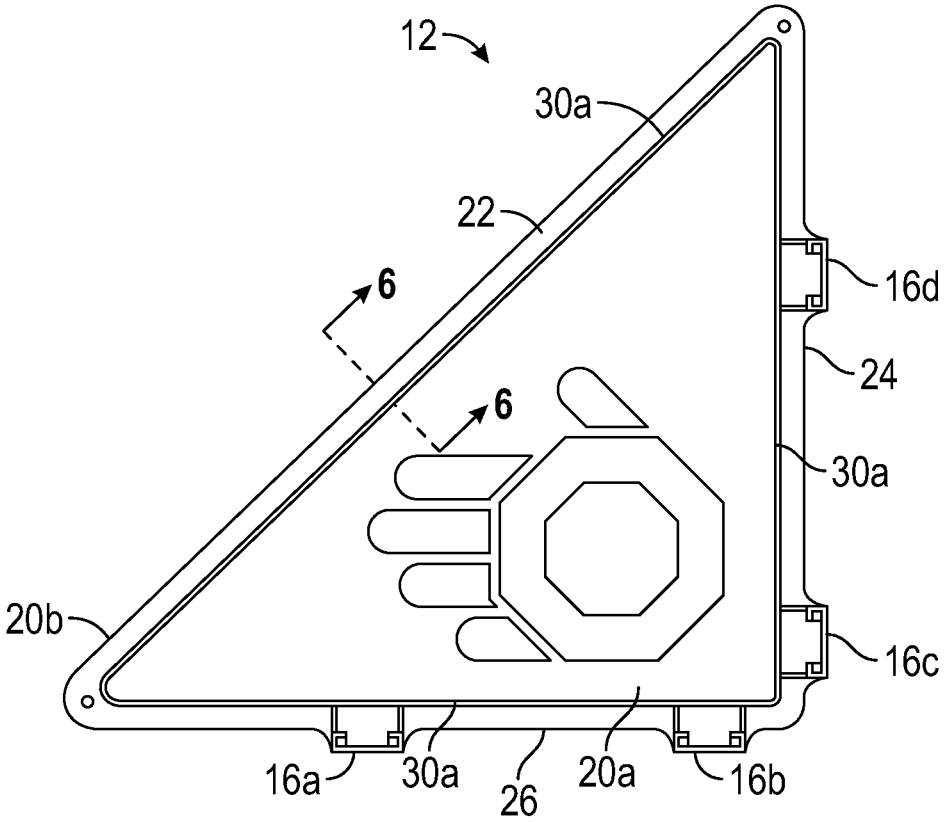
FIG. 5 is a side perspective view of a framework of the multi-purpose signage assembly of FIG. 1.

Referring now to FIG. 5, the framework 12 is illustrated. The framework 12 includes a first panel 20*a* and an opposing second panel 20*b*. The first panel 20*a* is configured to receive the first screen 14*a* and the second panel 20*b* is configured to receive the second screen 14*b*. The first and second panels 20*a*, 20*b* are bounded by a first edge 22, a second edge 24 and a third edge 26. The edges 22, 24, 26 cooperate to form a triangular shape with the first edge forming a hypotenuse 22. In the embodiment shown in FIG. 5, the edges 22, 24, 26 cooperate to form an isosceles right triangle. However, in other embodiments, the edges 22, 24, 26 can cooperate to form other triangular shapes. While the embodiment illustrated in FIGS. 1-5 shows the framework 12 as having the form of a triangle, it should be appreciated that in other embodiments, other desired shapes can be used, such as the non-limiting examples of square shapes, rectangular shapes, octagonal shapes and the like.

Figure 6:
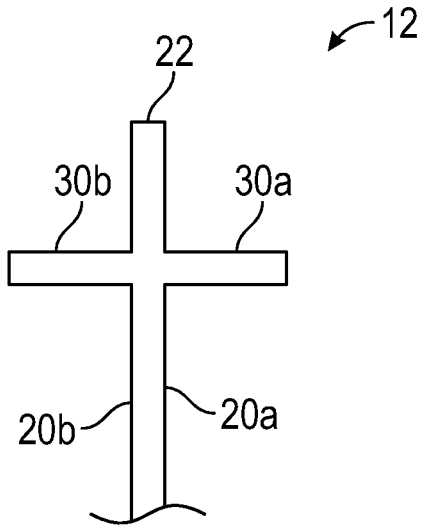
FIG. 6 is a cross-sectional view of a portion of a first edge of the framework of FIG. 5.

Referring now to FIG. 6, a portion of the first edge 22, first panel 20*a* and second panel 20*b* of the framework 12 is illustrated in cross-section. The cross-section of the first edge 22 is representative of the cross-sections of the second and third edges 24, 26. A first rib 30*a*, positioned proximate the first edge 22, extends in a substantially perpendicular direction from the first panel 20*a*. Similarly, an opposing second rib 30*b*, positioned proximate the first edge 22 extends in a substantially perpendicular direction from the second panel 20*b*.

Referring again to FIG. 5, the first rib 30*a* and the second rib (not shown) extend along and proximate to the first, second and third edges 22, 24, 26. The first rib 30*a* and the second rib are configured to provide structural support to the framework 12. In the embodiment illustrated in FIG. 5, the first rib 30*a* positioned proximate the first, second and third edges 22, 24, 26 forms a continuous circumferential structure. In a similar manner, the second rib positioned proximate the first, second and third edges 22, 24, 26 forms a continuous circumferential structure. The continuous structures formed by each of the first and second ribs 30*a*, 30*b* is configured to provide structural support to the framework 12. However, it should be appreciated that in other embodiments, each of the first and second ribs 30*a*, 30*b* can form discontinuous structures, sufficient to provide structural support to the framework 12.

Referring now to the embodiment illustrated in FIG. 6, the first and second ribs 30*a*, 30*b* each have an identical rectangular cross-sectional shape. In alternate embodiments, it is contemplated the first and second ribs and have other cross-sectional shapes and the cross-sectional shapes of the first and second ribs 30*a*, 30*b* can be different from each other, sufficient to provide structural support to the framework 12.

Referring again to the embodiment shown in FIG. 5, the framework 12 includes the plurality of slot assemblies 16*a*-16*d*. The slot assemblies 16*a*-16*d* will be discussed in more detail below. The framework 12, including the plurality of slot assemblies 16*a*-16*d*, is formed as a unitary, one-piece assembly. The unitary, one piece assembly advantageously provides structural support to the signage assembly 10. However, in other embodiments, the framework 12 can be configured from discrete elements that are assembled together.

Referring again to FIG. 5, the framework 12 is formed from a polymeric material, such as the non-limiting example of high-density polyethylene, configured to provide resistance against environmental elements and further configured to provide structural support to the framework 12. In alternate embodiments, the framework 12 can be formed from other suitable materials, sufficient to provide resistance against environmental elements and further configured to provide structural support to the framework 12.

Referring again to FIGS. 1 and 2, the reflective material forming the first screen 14*a* is applied to the first panel 20*a* and the reflective material forming the second screen 14*b* is applied to the panel 20*b*. In the illustrated embodiment, the first and second screens 14*a*, 14*b* are mirror images of each other, although such is not necessary for operation of the signage assembly 10. The reflective material forming the first and second screens 14*a*, 14*b* can be applied to the first and second panels 20*a*, 20*b* in any desired manner, including the non-limiting example of self-sticking adhesives.

Figure 1:
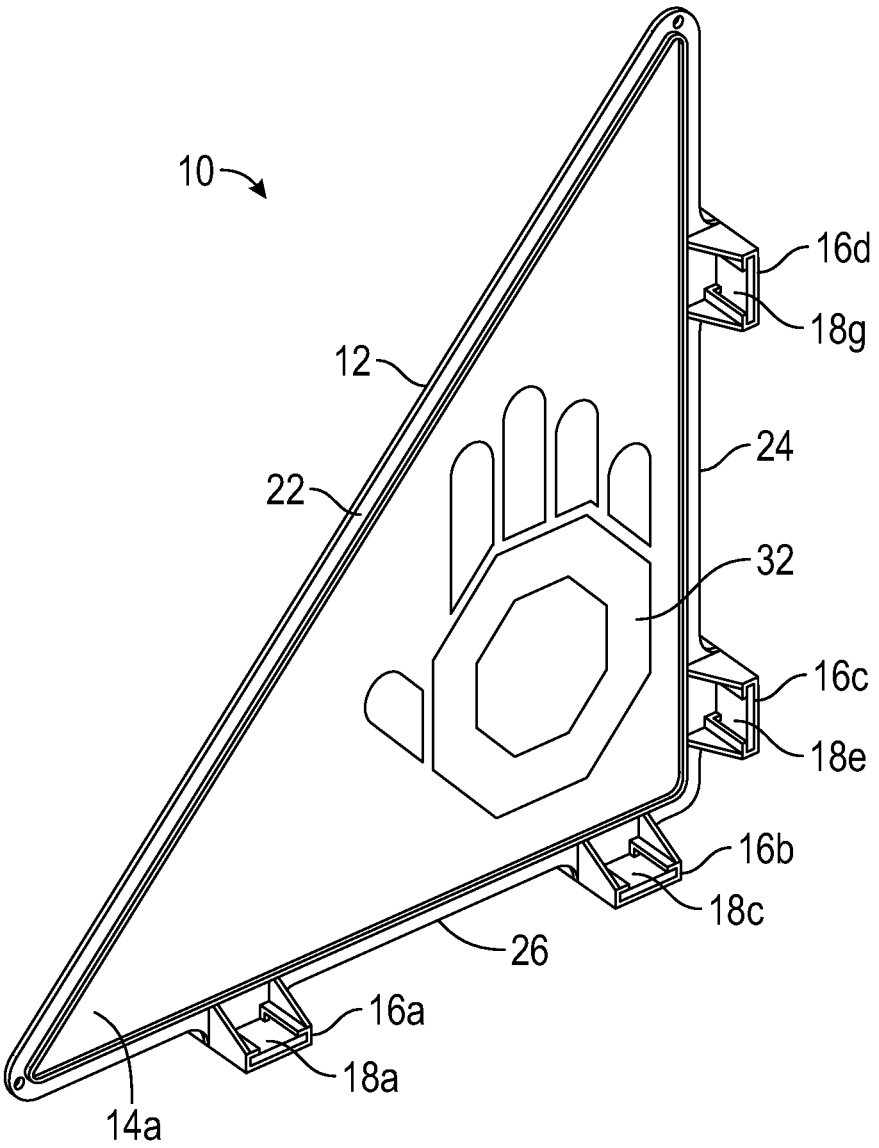
FIG. 1 is a left side perspective view of a multi-purpose signage assembly in accordance with the invention.
Figure 2:
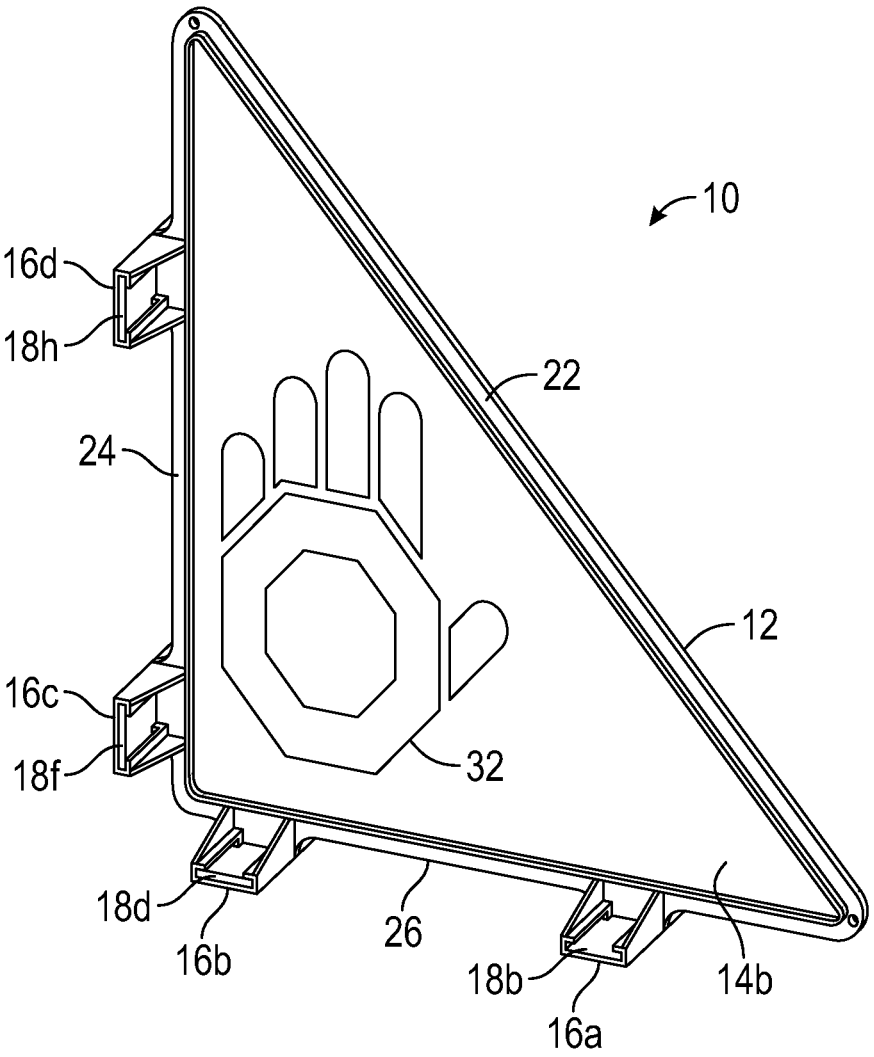
FIG. 2 is a right side perspective view of the multi-purpose signage assembly of FIG. 1.
Figure 3:
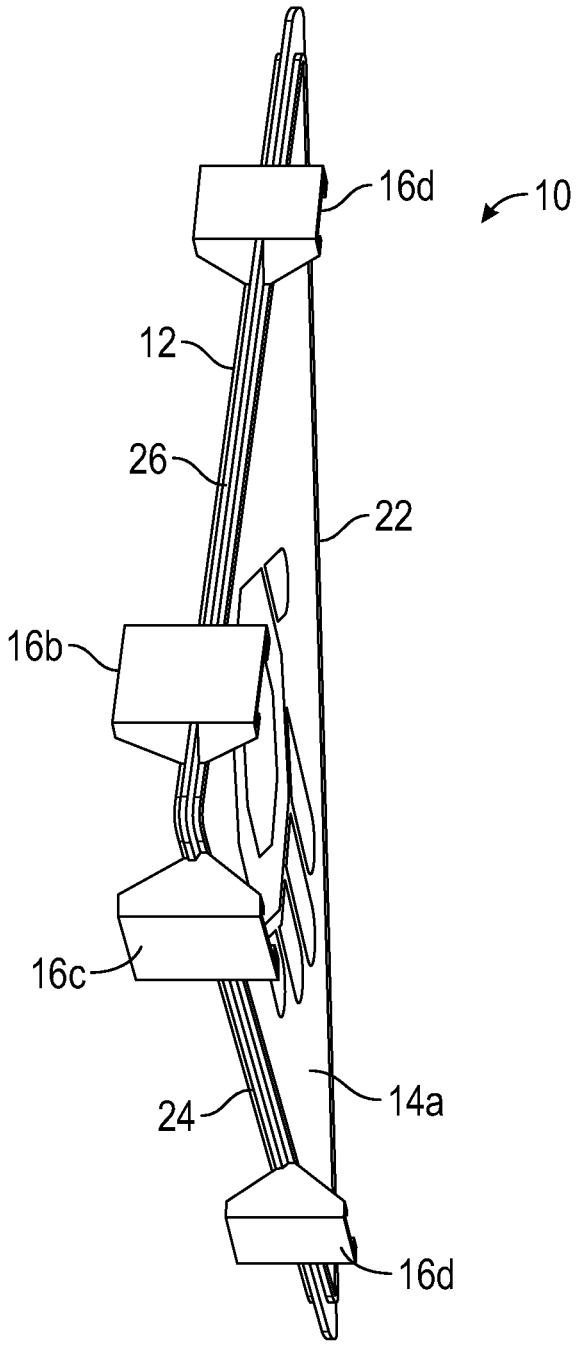
FIG. 3 is a rear perspective view of the multi-purpose signage assembly of FIG. 1.
Figure 4:
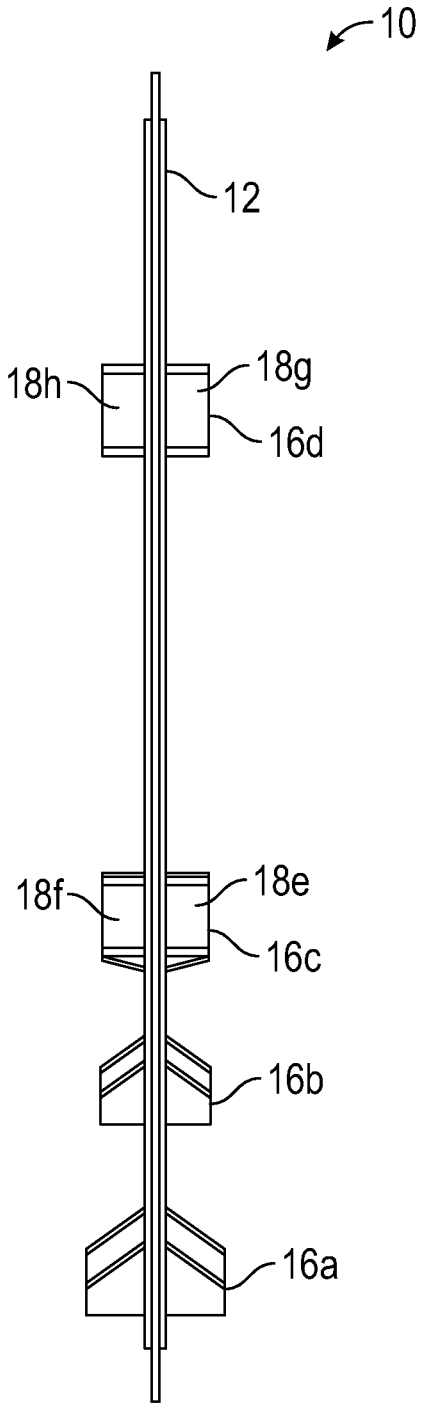
FIG. 4 is a front view of the multi-purpose signage assembly of FIG. 1.

Referring now to FIGS. 1 and 2, each of the first and second screens 14*a*, 14*b* has an outward face formed with a highly reflective and visible material. The highly reflective and visible material is configured to draw attention from afar. In the illustrated embodiment, the highly reflective and visible material is formed with full-cube prismatic technology, such as for example 3M™ Diamond Grade™ Reflective Sheeting, manufactured and marketed by 3M Corporation, headquartered in St. Paul, Minn. However, in other embodiments, other highly reflective and visible material can be used sufficient to draw attention from afar.

Referring again to FIGS. 1 and 2, optionally indicia 32 can be added to the outward faces of the first and second screens 14*a*, 14*b*. The indicia 32 can represent any desired symbol or message, such as the non-limiting examples of warnings messages and/or messages configured to draw attention and/or summon help.

Referring now to FIGS. 1-4, the spaced apart slot assemblies 16*a* and 16*b* extend from a portion of the third edge 26 and radially from the first and second panels 20*a*, 20*b* of the framework 12. In a similar manner, the spaced apart slot assemblies 16*c* and 16*d* extend from a portion of the second edge 24 and extend radially from the first and second panels 20*a*, 20*b* of the framework 12. While the illustrated embodiment shows a quantity of two slot assemblies forming a portion of each of the first and second edges 24, 26, in other embodiments, more or less than two slot assemblies can form a portion of each of the first and second edges 24, 26 of the framework 12.

Figure 7:
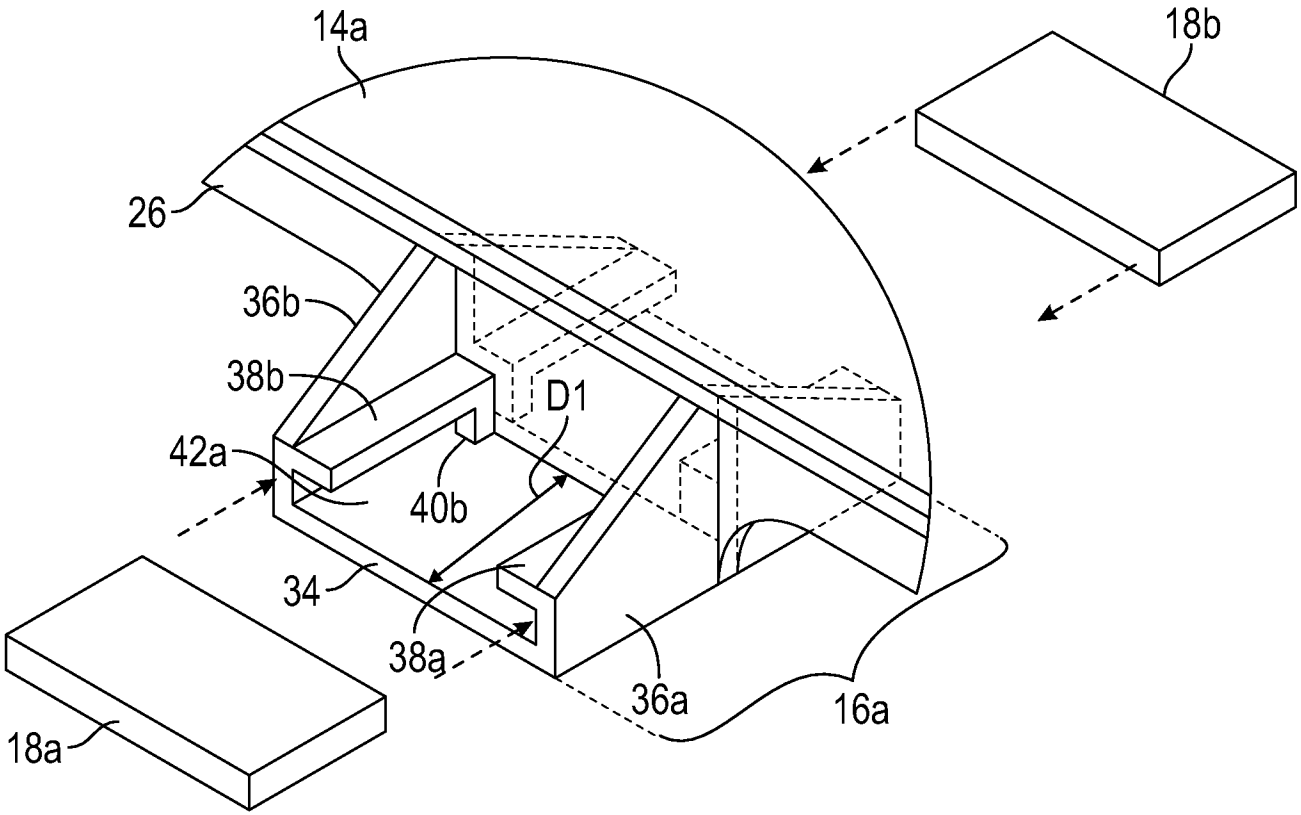
FIG. 7 is a perspective view of opposing slot assemblies of the multi-purpose signage assembly of FIG. 1.

Referring now to FIG. 7, the first screen 14*a*, slot assemblies 16*a*, 16*b*, and third edge 26 are illustrated. The slot assembly 16*a* is representative of the slot assemblies 16*b*-16*d*. Generally, the slot assembly 16*a* is configured to receive and position a magnet 18*a* in a desired alignment with a magnet 18*b* inserted into the slot assembly 16*b*. The slot assembly 16*a* includes a base wall 34, opposing first and second side walls 36*a*, 36*b* extending from the base wall 34 and retaining walls 38*a*, 38*b* extending from the opposing first and second side walls 36*a*, 36*b*. Opposing first and second retaining walls 38*a*, 38*b* extend from the opposing first and second side walls 36*a*, 36*b* in a direction toward each other. A first back wall (not shown for purposes of clarity) is positioned adjacent the third edge 26 and extends from the first retaining wall 38*a* to the base wall 34. In a similar manner, a second back wall 40*b* is positioned adjacent the third edge 26 and extends from the second retaining wall 38*b* to the base wall 34.

Referring again to FIG. 7, taken together, the base wall 34, first and second side walls 36*a*, 36*b*, first and second retaining walls 38*a*, 38*b* and the first and second back walls 40*a*, 40*b* define a magnet cavity 42*a*. The magnet cavity 42*a* has a rectangular cross-sectional shape that approximates a rectangular cross-sectional shape of the magnet 18*a*. The magnet cavity 42*a* extends inward in a direction toward the third edge 26 of framework 12 a distance D1. The distance D1 is limited by a thickness of the first and second back walls 40*a*, 40*b*.

Referring again to FIG. 7, an opposing magnet cavity 42*b* is formed in the opposing slot assembly 16*b*. The opposing magnet cavity 42*b* in slot assembly 16*b* is aligned with the magnet cavity 42*a* in the slot assembly 16*a* and extends inward in a direction toward the third edge 26 of framework 12.

Figure 8A:
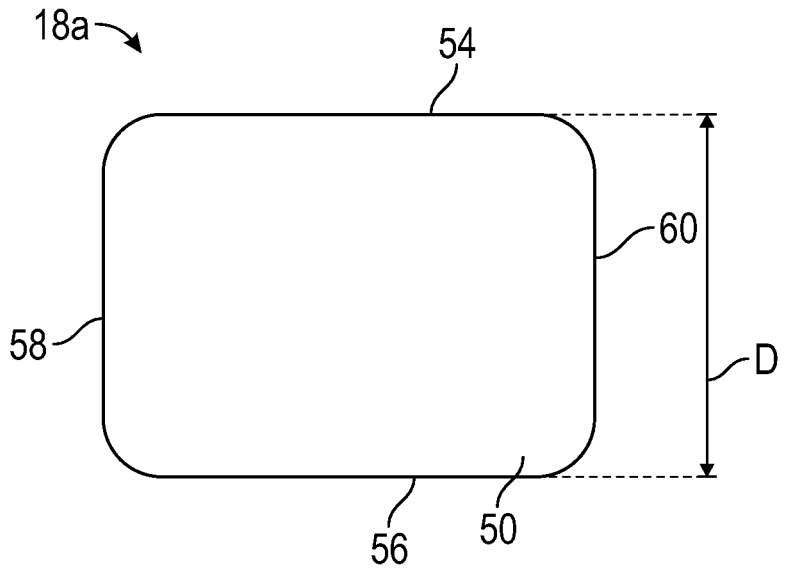
FIG. 8A is a plan view of a magnet of the multi-purpose signage assembly of FIG. 1.
Figure 8B:
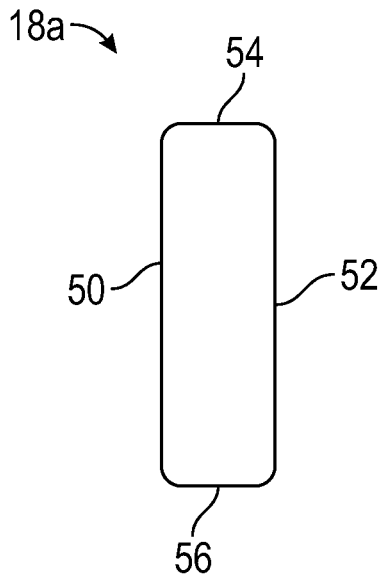
FIG. 8B is a side view of the magnet of FIG. 8A.
Figure 8C:
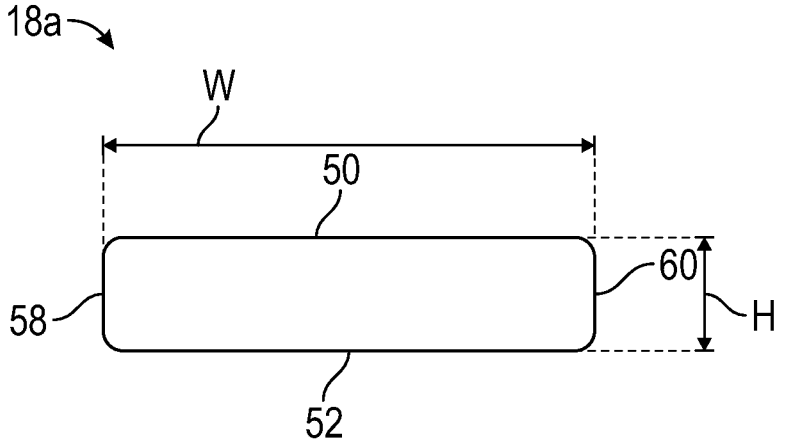
FIG. 8C is a front view of the magnet of FIG. 8A.

Referring now to FIGS. 8A-8C, the magnet 18*a* is illustrated. The magnet 18*a* is representative of the magnets 18*b*-18*h*. The magnet 18*a* has a rectangular cross-sectional shape and size with first and second major faces 50, 52, first and second longitudinal edges 54, 56 and first and second lateral edges 58, 60. It should be appreciated that the magnets 18*a*-18*h* can have other shapes and sizes sufficient for the purposes described herein. The magnet 18*a* has a width W, a depth D and a height H. In the illustrated embodiment, the width W is about 1.000 inches, the depth D is about 0.500 inches and the height H is about 0.125 inches. In other embodiments, the width W can be more or less than about 1.000 inches, the depth D can be more or less than about 0.500 inches and the height H can be more or less than about 0.125 inches, sufficient for the purposes described herein. Advantageously, the magnets 18*a*-18*h* and their associated magnet cavities 42*a*-42*h* are sized in a mariner such that the magnets 18*a*-18*h* freely slip into the cavities 42*a*-42*h* without interference and without the need for special installation tools.

Referring again to FIGS. 8A-8C, the magnet 18*a* is a rare earth permanent magnet and is formed from a metal alloy material or combination of metal alloy materials having extremely high magnetic properties. Acceptable metal alloy materials include neodymium iron boron (Nd—Fe—B), samarium cobalt (SmCo5 or Sm2Co17) and aluminum nickel cobalt (AlNiCo), although other metal alloys can be used. In the illustrated embodiment, the magnet 18*a* has a pull force in a range of from about 5.0 lbs to about 15.0 lbs and a surface field in a range of from about 4,000 Guass to about 8,000 Gauss. However, in other embodiments, the magnet 18*a* can have a pull force less than about 5.0 lbs or more than about 15.0 lbs and a surface field less than about 4,000 Guass or more than about 8,000 Gauss, sufficient for the functions described herein. One non-limiting example of a suitable magnet 18*a* is the neodyminum block magnet model number BX028, marketed by K&J Magnetics Inc., headquartered in Pipersville, Pa., although other magnets can be used.

Referring again to FIGS. 1 and 2, while the illustrated embodiment shows a lone magnet 18*a*-18*h* seated in the respective cavities of the slot assemblies 16*a*-16*d*, it should be appreciated that in other embodiments, a plurality of magnets can be seated in the respective cavities of the slot assemblies 16*a*-16*d*.

Figure 9:
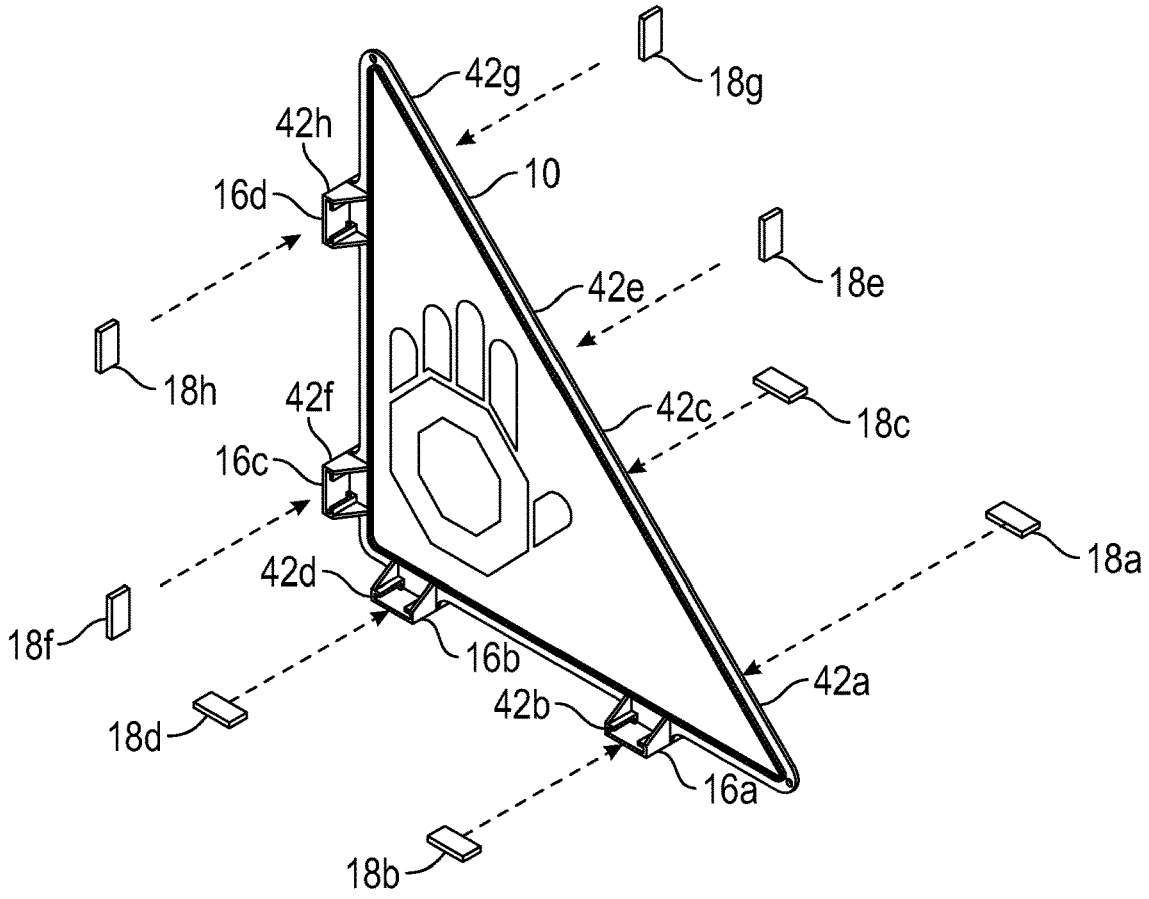
FIG. 9 is a perspective view of a framework of the multi-purpose signage assembly of FIG. 1, illustrating insertion of a plurality of magnets of FIGS. 8A-8C.

Referring now to FIG. 9, the magnets 18*a*-18*d* are shown in a generally horizontal orientation prior to insertion into the magnet cavities 42*a*-42*d* formed in the respective slot assemblies 16*a* and 16*b*. The magnets 18*e*-18*h* are shown in a generally vertical orientation prior to insertion into the magnet cavities 42*e*-42*h* formed in the respective slot assemblies 16*c* and 16*d*. Advantageously, insertion of the magnets 18*a*-18*h* into their respective magnet cavities 42*a*-42*h* and removal of the magnets 18*a*-18*h* from their respective magnet cavities 42*a*-42*h* can be accomplished manually and without the need for special tools, tooling, mechanisms or apparatus.

Figure 10:
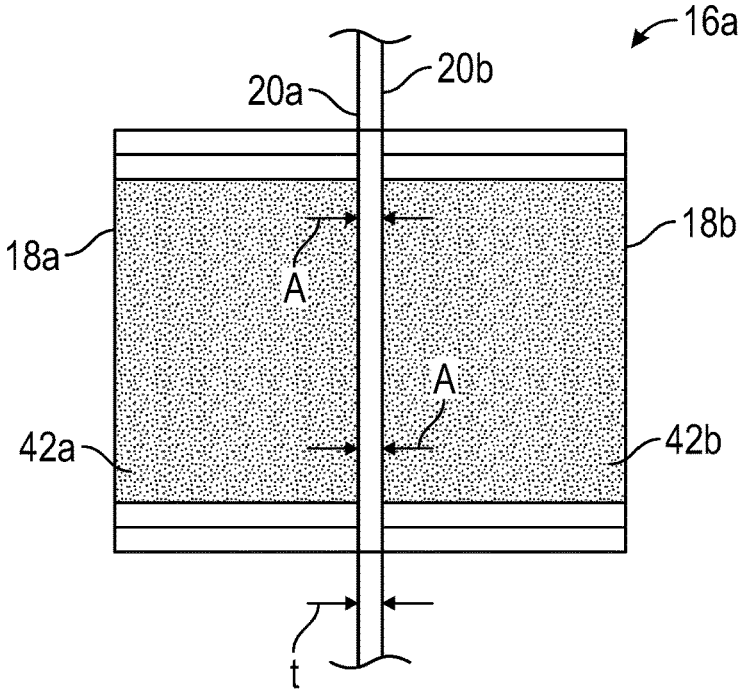
FIG. 10 is a plan view of the opposing slot assemblies of FIG. 7 showing opposing magnets in an installed arrangement.

Referring now to FIG. 10, the slot assembly 16*a* is illustrated with each of the opposing magnets 18*a*, 18*b* in a seated position within their respective magnet cavities 42*a*, 42*b*. When installed in the magnet cavities 42*a*, 42*b*, the opposing magnets 18*a*, 18*b* are separated by a thickness t of the framework 12 forming the first and second panels 20*a*, 20*b*. Further when installed in the magnet cavities 42*a*, 42*b*, the opposing magnets 18*a*, 18*b* are configured with sufficient magnetic strength that they attract each other in a manner (schematically shown by magnetic attraction arrows A) such that additional retention structures, mechanisms and devices are unnecessary to maintain the magnets 18*a*, 18*b* in their respective cavities. As should be appreciated, the thickness t and the magnetic strength of the opposing magnets 18*a*, 18*b* can be adjusted in a manner such that additional retention structures, mechanisms and devices are unnecessary to maintain the magnets 18*a*, 18*b* in their respective cavities.

Figure 11:
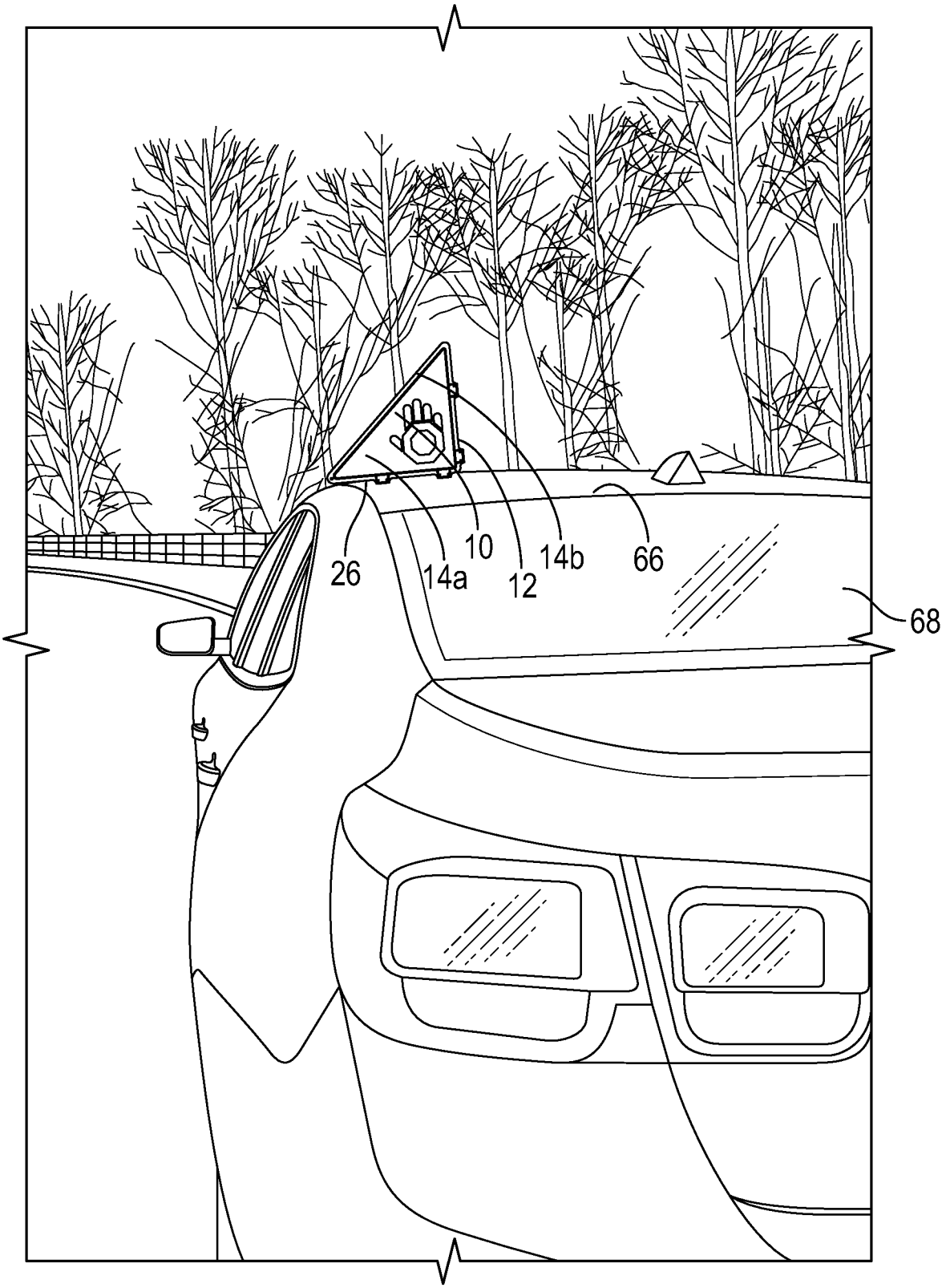
FIG. 11 is a perspective view of a first installation arrangement of the multi-purpose signage assembly of FIG. 1.

Referring now to FIG. 11, the signage assembly 10 is shown in a first installation arrangement. In this arrangement, the side 26 of the framework 12 is positioned adjacent a ferrous surface 66 of an automobile 68. In this position, the magnets 18*a*-18*d* positioned in the slot assemblies 16*a*, 16*b* are attracted to the ferrous surface 66 with sufficient magnetic force to maintain the signage assembly 10 in place. Accordingly, it should be appreciated that each of the opposing pairs of magnets provide the dual functions of attraction to each other to maintain the magnets in their respective cavities and also attraction of the signage assembly 10 to the ferrous surface 66 with sufficient magnetic force to maintain the signage assembly 10 in place. It should be noted that in the first installation arrangement, the signage assembly 10 is orientated with the first and second screens 14*a*, 14*b* arranged to be substantially perpendicular to a longitudinal axis of the automobile 68, thereby providing maximum visibility to engaging traffic. In other embodiments, the first and second screens 14*a*, 14*b* can have other arrangements to maximize visibility.

Figure 12:
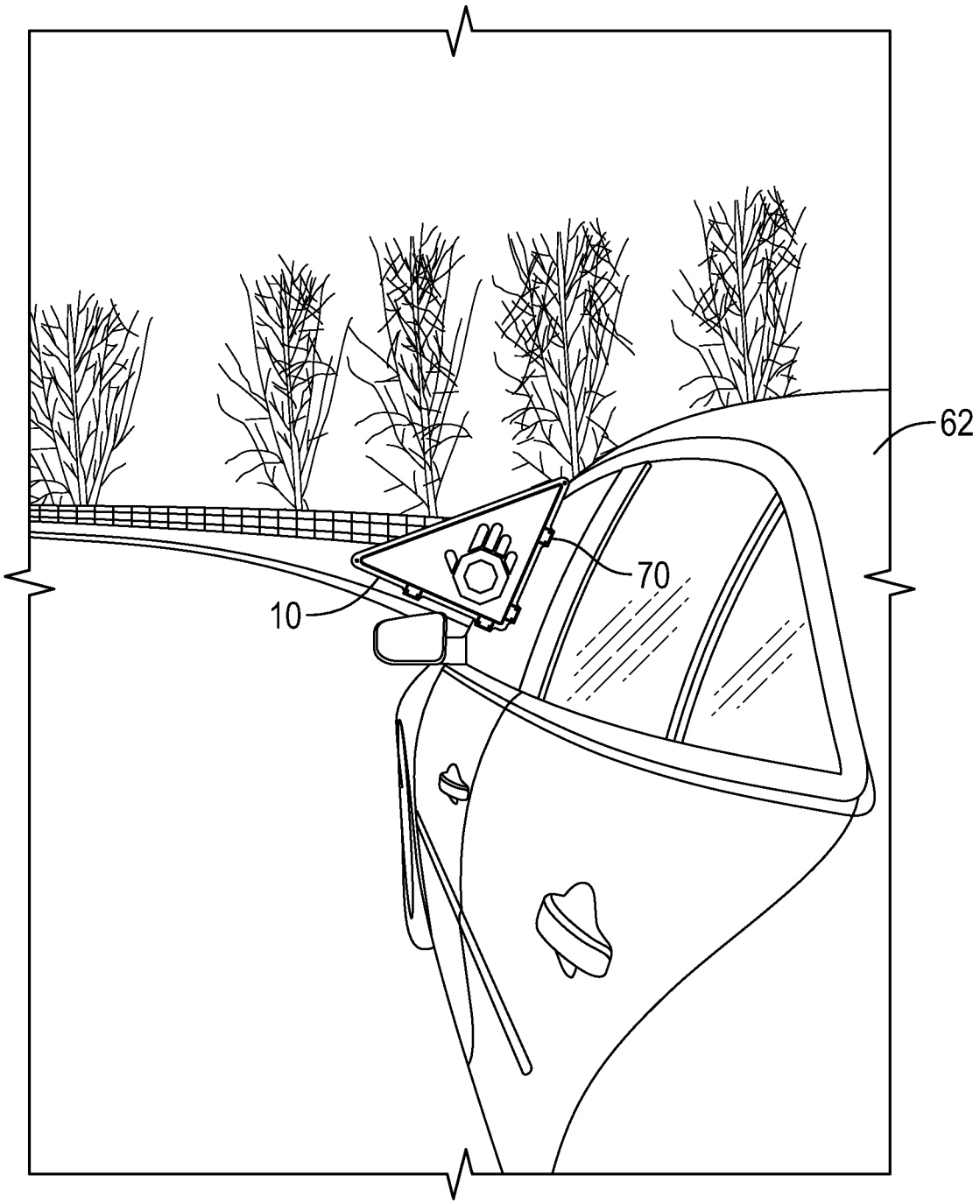
FIG. 12 is a perspective view of a second installation arrangement of the multi-purpose signage assembly of FIG. 1.
Figure 13:
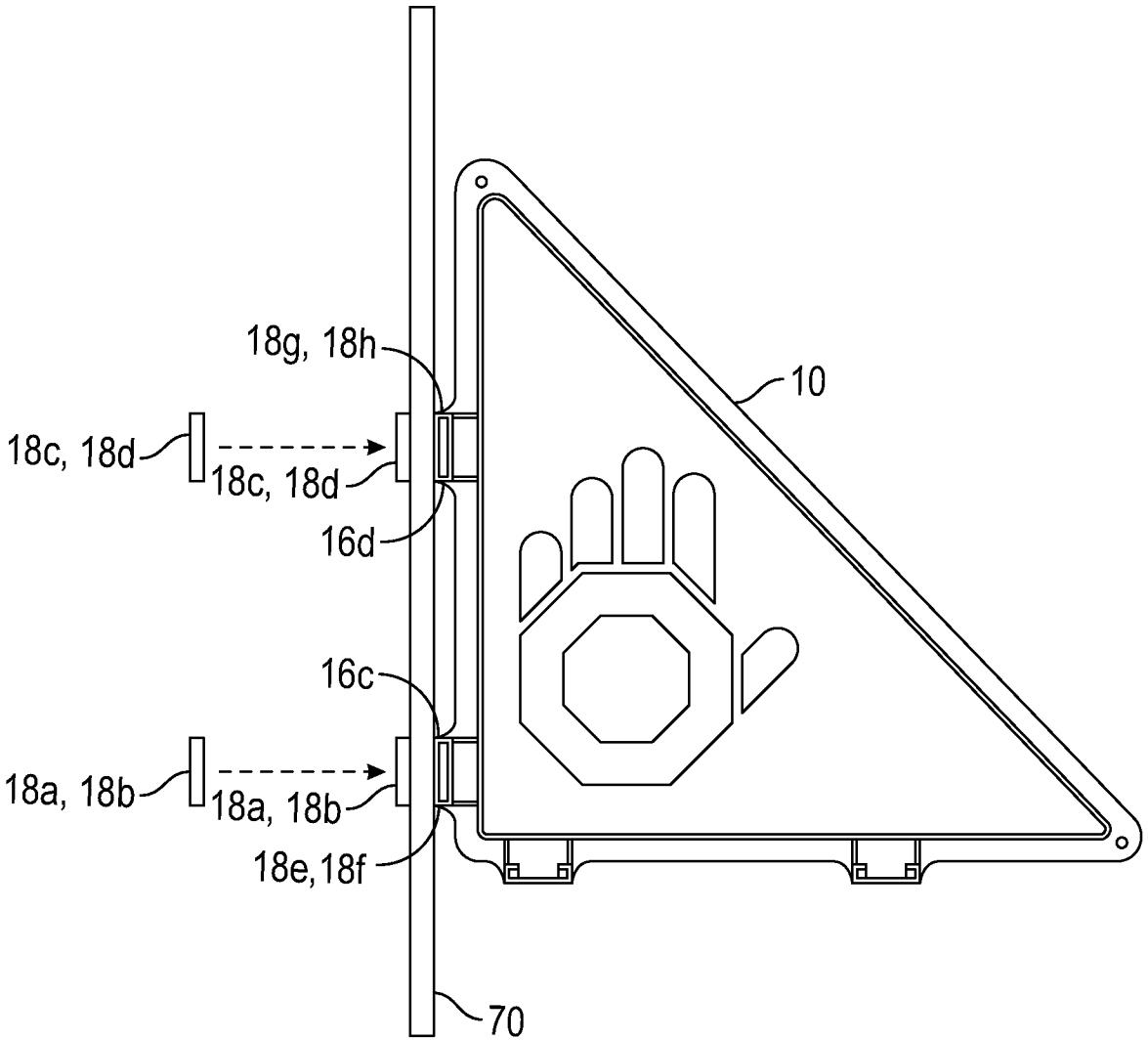
FIG. 13 is a side view of the second installation arrangement of the multi-purpose signage assembly of FIG. 1.

Referring now to FIGS. 12 and 13, the signage assembly 10 is shown in a second installation arrangement. In this arrangement, the signage assembly 10 is equipped with a quantity of eight (8) magnets 18*a*-18*h* and the signage assembly 10 is fixed against a non-ferrous surface, such as the non-limiting example of glass window 70 of the automobile 62. In this position, the magnets 18*e*, 18*f*, 18*g* and 18*h* are positioned in the slot assemblies 16*c*, 16*d* and the slot assemblies 16*c*, 16*d* are positioned against one surface of the window 70. Two pairs of opposing magnets 18*a*, 18*b*, 18*c* and 18*d* are positioned on the opposite side of the window 70. The four pairs of magnets: 18*a* and 18*b*, 18*c* and 18*d*, 18*e* and 18*f* and 18*g* and 18*h* are aligned with each other such that the magnets on opposing sides of the window 70 are attracted to each other with sufficient magnetic force to maintain the signage assembly 10 in place.

While the multi-purpose signage assembly is described above and shown in FIGS. 1-3 and 11-13 as having one or more highly reflective and visible screens 14*a*, 14*b*, it is contemplated that the multi-purpose signage assembly could incorporate screens configured to be highly visible with other structures, features, mechanisms and devices, such as the non-limiting examples of one or more screens that illuminate or glow.

In accordance with the provisions of the patent statutes, the principle and mode of operation of the multi-purpose signage assembly have been explained and illustrated in certain embodiments. However, it must be understood that the multi-purpose signage assembly may be practiced otherwise than as specifically explained and illustrated without departing from its spirit or scope.

What is claimed is:

1. A multi-purpose signage assembly comprising:

a framework having a plurality of edges, the edges bounding opposing first and second panels;

a first screen received by the first panel;

a second screen received by the second panel;

one of the plurality of edges having a plurality of slot assemblies;

another of the plurality of edges having a plurality of slot assemblies, wherein one of the slot assemblies has a cavity defined by a base wall, opposing first and second side walls, first and second retaining walls and first and second back walls;

a plurality of opposing magnets positioned in the plurality of slot assemblies of one of the edges or the slot assemblies of the other edge, wherein the plurality of opposing magnets are configured to attract each other in a manner such as to retain the opposing magnets in the slot assemblies, the plurality of opposing magnets further configured to attach the multi-purpose signage assembly to a ferrous surface with sufficient magnetic force to maintain the multi-purpose signage assembly in place.

2. The multi-purpose signage assembly of claim 1, wherein the framework has a quantity of three edges and forms a triangular shape.

3. The multi-purpose signage assembly of claim 1, wherein the cavity has a rectangular cross-sectional shape.

4. The multi-purpose signage assembly of claim 3, wherein all of the slot assemblies have the same structure.

5. The multi-purpose signage assembly of claim 1, wherein the opposing magnets in a slot assembly are separated from each other by a portion of the framework.

6. The multi-purpose signage assembly of claim 1, wherein the framework includes a circumferential rib positioned proximate each of the edges.

7. The multi-purpose signage assembly of claim 1, wherein the first and second screens each have the form of a reflective panel incorporating full-cube prismatic technology.

8. The multi-purpose signage assembly of claim 1, wherein the magnets are configured for manual insertion into their respective slot assemblies and removal from their respective slot assemblies without the need for special tools, tooling, mechanisms or apparatus.

9. The multi-purpose signage assembly of claim 1, wherein each of the magnets has the form of a rare earth permanent magnet.

10. A multi-purpose signage assembly comprising:

a framework having a plurality of edges, the edges bounding opposing first and second panels, the framework positioned on one side of a non-ferrous material;

a first screen received by the first panel;

a second screen received by the second panel;

one of the plurality of edges having a plurality of slot assemblies;

another of the plurality of edges having a plurality of slot assemblies, wherein one of the slot assemblies has a cavity defined by a base wall, opposing first and second side walls, first and second retaining walls and first and second back walls;

a first plurality of opposing magnets positioned in the plurality of slot assemblies of one of the edges or the slot assemblies of the other edge, the first plurality of opposing magnets configured to attract each other in a manner such as to retain the opposing magnets in the slot assemblies;

a second plurality of opposing magnets positioned on an opposing side of the non-ferrous material and configured to attract to the first plurality of opposing magnets with sufficient magnetic force to maintain the multi-purpose signage assembly in place against the non-ferrous material.

11. The multi-purpose signage assembly of claim 10, wherein the framework has a quantity of three edges and forms a triangular shape.

12. The multi-purpose signage assembly of claim 10, wherein the cavity has a rectangular cross-sectional shape.

13. The multi-purpose signage assembly of claim 10, wherein all of the slot assemblies have the same structure.

14. The multi-purpose signage assembly of claim 10, wherein the opposing magnets in a slot assembly are separated from each other by a portion of the framework.

15. The multi-purpose signage assembly of claim 10, wherein the framework includes a circumferential rib positioned proximate each of the edges.

16. The multi-purpose signage assembly of claim 10, wherein the first and second screens each have the form of a reflective panel incorporating full-cube prismatic technology.

17. The multi-purpose signage assembly of claim 10, wherein the magnets are configured for manual insertion into their respective slot assemblies and removal from their respective slot assemblies without the need for special tools, tooling, mechanisms or apparatus.

18. The multi-purpose signage assembly of claim 10, wherein each of the magnets has the form of a rare earth permanent magnet.

* * * * *